United States Patent [19]

Shelton

[11] 4,286,417

[45] Sep. 1, 1981

[54] BLASTING MACHINE WITH POSITION SENSING AND ADJUSTMENT

[75] Inventor: John J. Shelton, Tuttle, Okla.

[73] Assignee: Robert T. Nelson, Oklahoma City, Okla.

[21] Appl. No.: 64,753

[22] Filed: Aug. 8, 1979

[51] Int. Cl.[3] ..... B24C 3/06

[52] U.S. Cl. ..... 51/415; 51/429

[58] Field of Search ..... 51/415, 429; 114/222

[56] References Cited

U.S. PATENT DOCUMENTS

| | | | |
|---|---|---|---|
| 3,566,543 | 3/1971 | Fogle | 51/429 X |
| 3,705,565 | 12/1972 | Hammelmann | 114/222 |
| 3,747,277 | 7/1973 | Carpenter | 51/429 X |
| 3,864,876 | 2/1975 | Diehn | 51/429 |
| 3,908,314 | 9/1975 | Watanabe | 51/429 |
| 3,911,849 | 10/1975 | Hammelmann | 51/429 X |
| 3,951,092 | 4/1976 | van den Bruek | 51/415 X |
| 4,064,656 | 12/1977 | Ziedler | 51/429 X |
| 4,139,970 | 2/1979 | Hockett | 51/429 X |

*Primary Examiner*—Gary L. Smith

*Attorney, Agent, or Firm*—Bernard, Rothwell & Brown

[57] ABSTRACT

A method and apparatus for moving a blasting machine along a surface to be treated while maintaining a desired disposition of the blasting machine relative to the surface being treated. A support structure having a moveable boom with a blasting machine on its distal end is positioned adjacent the surface for treatment. Means are provided on the blasting machine to sense the positions of the blasting machine relative to the surface for treatment as the boom is moved through a working path. Movements of the blasting machine away from the desired disposition are sensed and compensated to adjust the blasting machine toward the intended disposition substantially throughout the movement of the boom through the working path.

24 Claims, 11 Drawing Figures

BLASTING MACHINE WITH POSITION SENSING AND ADJUSTMENT

BACKGROUND AND DISCUSSION OF THE INVENTION

In treating certain surfaces and particularly large surfaces on an industrial scale, blasting machines have been employed as a way of efficiently cleaning surfaces particularly where removal of paint, rust, or other undesirable surface material is required. Such blasting machines typically include a unit having a blasting wheel for propelling abrasive material against the surface to be cleaned. The blasting area or zone to which the abrasive is propelled is substantially enclosed such that the abrasive, as well as the surface material removed by the abrasive, are not unduly expelled to the surrounding atmosphere. In communication with this enclosure is a system for receiving the spent abrasive and returning it to the blasting wheel for recycling in cleaning the surface being treated.

On relatively horizontal surfaces these blasting machines can be moved and operated quite readily by hand, cars, trucks and the like. When treating surfaces which extend substantially towards a vertical direction, the apparatus for moving the machines has become more complex. Often for large storage tanks and ship hulls, a special structure has been developed which suspends the blasting machine on the side of the surface to be treated and lowers the machine along a prescribed path vertically and, in addition, moves the machine horizontally to abrade and clean the surface being treated. This type of apparatus involves either maintaining portions of the machine-supporting and manipulating structure on each surface to be treated, or rebuilding a structure on the surface each time it has to be cleaned by the blasting machine. This is not only an expensive and time consuming proposition, it often requires the placing of rails or other guiding devices in an unsightly fashion on the surfaces to be treated to insure the proper movement of the blasting machine.

There have been some portable structures which have adopted mechanisms for moving the blasting machine across the working path along the vertical surface without the need to relay on tracks and other structures mounted on the surface. However, the devices developed thus far are rather awkward in their operation and require undue operator control to maintain the correct position and contact of the blasting machine with the surface being treated. This is true particularly where the surface is not flat but is round or has indentations and, as a result, the disposition of the blasting wheel must change several times relative to the surface being treated during its movement through a working path. Such devices have included magnetic or vacuum mechanisms which are cumbersome and often require some additional supporting structure. In addition, some of these devices have required that the blasting wheel be located in a position somewhat remote from the area being cleansed. This of course results in additional loss of abrasive velocity durings its travel along the extra distance from the wheel to the surface, and even prevents such a system from being used on surfaces that are high above the ground.

Some other portable devices such as that shown in U.S. Pat. No. 3,908,314 to Watanabe et al., have incorporated a telescopic boom on a swingable frame for moving a blasting machine through a path along the surface being treated. An expandable frame carrying the blasting machine is located on the end of the telescopic boom. To place the machine in contact with the surface disposed at an angle to the vertical, the operator must control movement of the machine into the correct disposition. In this operation one of the frames moves on another through the action of a series of ropes and pulleys to provide proper machine orientation with respect to the angled surface being treated. During movement of the machine through the working path, the burden falls on the operator to make the necessary adjustments and insure that the blasting machine is maintained in the correct disposition as it moves along the surface.

The present invention largely avoids problems which have characterized the use of blasting machines to treat surfaces that are in a substantially inclined to the vertical plane. A simple but effective mechanism has been devised which achieves the desired disposition of the blasting machine adjacent the surface as it moves through a blasting path or swath, regardless of surface angle to the vertical and with minimal effort by the operator. Once the blasting machine is placed in a correct disposition adjacent the surface and motion initiated through the working path, the orientation of the blasting machine will be automatically adjusted to compensate for changes in the surface configuration as the machine is moved along the working path.

For this purpose a portable support structure is provided adjacent, but essentially unsupported by, the surface to be treated and has a telescopic boom extending from the support structure. The distal end of the boom has a blasting wheel device capable of being moved in various rotatable and pivotal directions. A series of sensors are positioned in the vicinity of the blasting zone of the blasting machine to sense the position of the machine relative to the surface being treated. These sensors are integrated with means on the distal end of the machine, as well as means located near the support structure for articulating and otherwise adjusting the position of the machine depending on the angle or curvature of the surface sensed.

The mechanism described herein provides for two principal modes of operation, among others. In a first mode a truck acting as a support structure can be parked parallel to the surface being blasted and far enough away that the boom when retracted can be positioned over the side of the truck. The blasting machine will be held in proper relationship to the surface being blasted while the machine is moved through a vertical swath or other working path. To blast through a new swath the operator can rotate the boom to the next position, typically adjacent the path previously blasted, and move the machine through another working path which may be coextensive with the previous path. A second mode of operation can be used particularly in those cases where there is insufficient room to rotate the retracted boom over the side of the truck. In this situation the truck can be parked close to the vertical surface, and the boom moved until the blast head contacts the surface with the boom over the corner of the truck adjacent the surface. The blast head is then held in the proper relationship to the surface as the operator controls the extension and elevation of the boom to blast successive arcs or other geometric patterns on the surface treated.

Because of the flexibility of the boom with the large mass on its end, the precision of positioning the blasting machine by the controls may be limited. Consequently, the frame, which defines the blasting zone, can be allowed to float relative to the remainder of the blasting machine and may be spring loaded by, for instance, air cylinders in order to bias the floating frame toward the surface to be treated. An elastomer seal surrounds the blasting zone for engaging the surface being treated and thereby preventing undue expulsion of abrasive to the surrounding atmosphere. Adjustable casters on the floating frame extend toward the surface to be treated and prevent crushing of the elastomer seal by the force from the air cylinders.

With the various features of the present invention, which will more clearly be appreciated in the preferred embodiment described hereinafter, the problems mentioned above with prior blasting devices have been overcome at least to a large extent. The sensing mechanism along with the system for moving the blasting wheel eliminates a substantial amount of what otherwise would be operator controlled effort. In addition, the articulating mechanism avoids the rather cumbersome and unreliable system of multiple frames and tracks along with pulleys and chains or cables which have characterized other more or less portable systems.

DETAILED DESCRIPTION OF THE PREFERRED EMBODIMENT

In the following description, a method and apparatus for two types of modes of operation of the present invention will be described for cleaning or abrading surfaces at various heights above the ground. In those areas where the apparatus can be placed in a position sufficiently spaced from the surface to be cleansed, the apparatus can, when desired, function to cut a generally vertical swath along the path to be cleansed as can be seen in FIG. 2. Particularly in those areas where a sufficiently displaced location for the apparatus with respect to the surface to be treated can not be achieved for cutting the vertical swath, the apparatus can be adjusted to cut an arcuate or other path along the surface to be treated in a manner that allows the apparatus to be located much closer to the surface to be treated. As the apparatus for accomplishing these modes of operation are generally the same, the elements constituting the apparatus will be described in large part in connection with FIGS. 1 and 2, with references to FIG. 3 being made to point out differences in operation.

Figure 1:
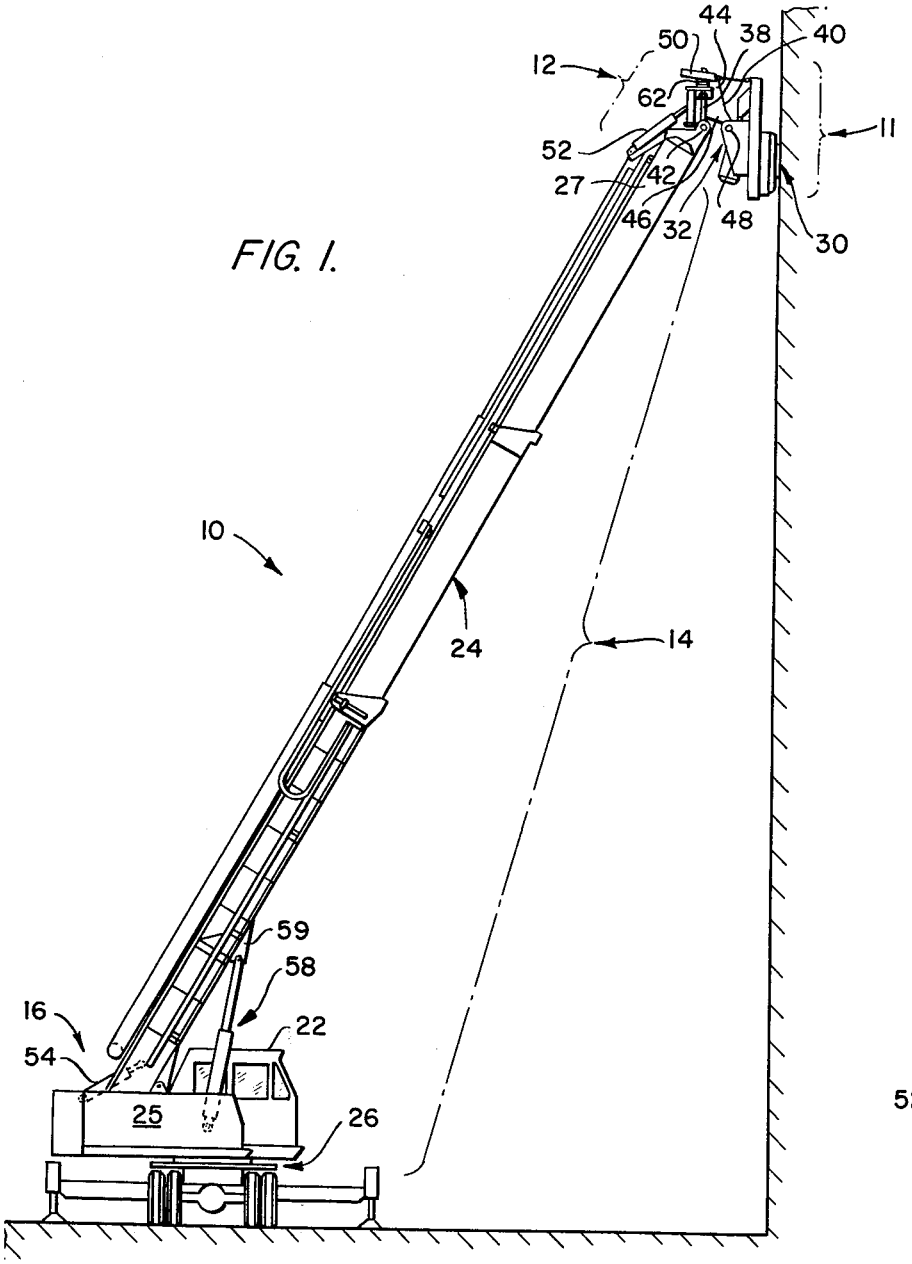
FIG. 1 is a side view of the apparatus for moving the blasting machine with the boom in an extended position according to a first mode of using the device.
Figure 2:
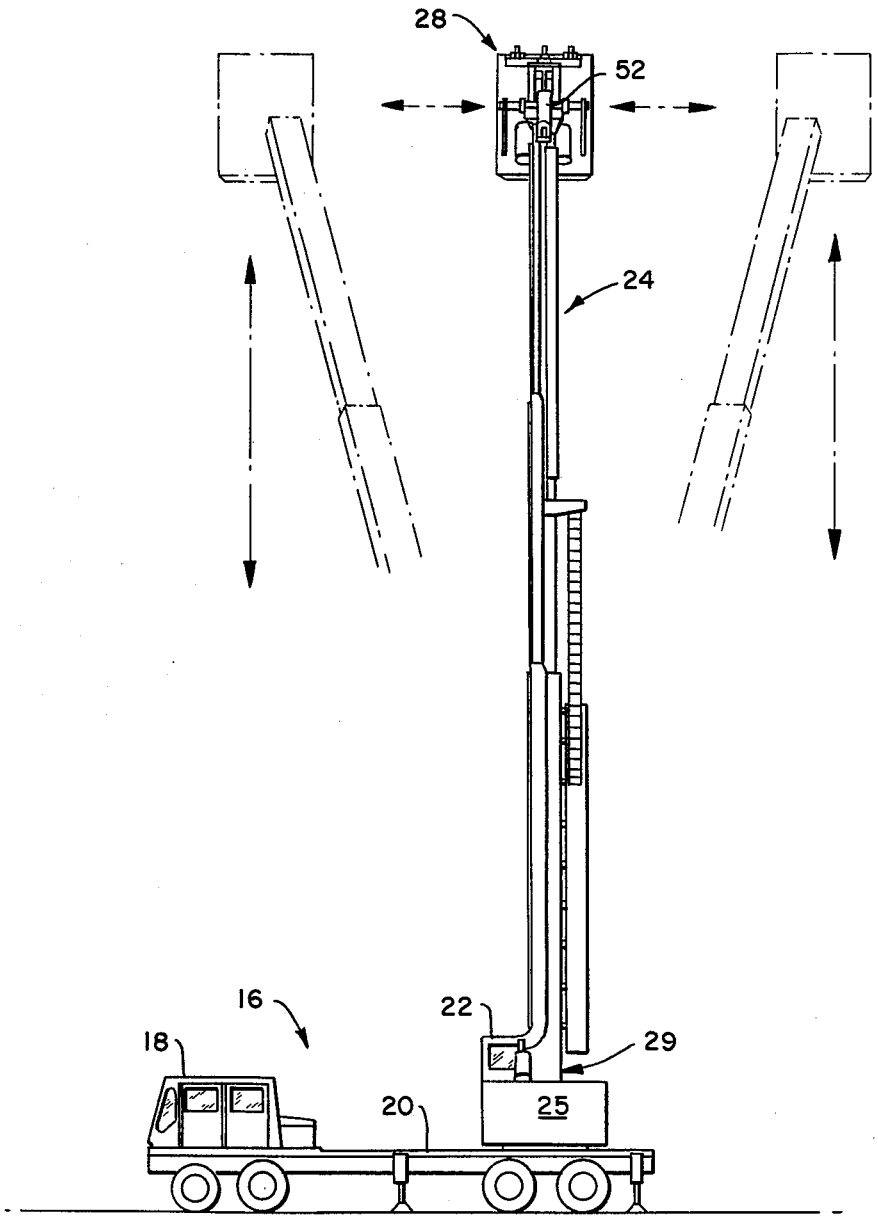
FIG. 2 is a rear view of the apparatus with the boom in an extended position.

As shown in FIG. 1 the portable apparatus 10 includes three principal sub-assemblies which comprise the apparatus. These sub-assemblies include blast head assembly 11 and actuating assembly 12, the latter being carried and supported by boom and support assembly 14. Although the apparatus could be described by referring to other sub-assemblies, for purposes of convenience and clarity the description of the three sub-assemblies will be adequate to understand and appreciate the significance of the invention.

The boom and support assembly 14 includes a truck 16 with a cab 18 on the forward part of the truck. Truck bed 20 extends rearwardly from the cab for carrying other parts of the boom and support assembly 14. This includes a boom cab 22 having a boom mount 25 extending rearwardly from the boom cab and positioned laterally therefrom to support the telescopic boom 24. To enable boom cab 22, boom 24 and boom mount 25 to rotate as a unit, they are mounted on rotating bed 26 of bed 20 of the truck. As the operation of boom cab 22, boom mount 25 and boom 24 on rotating bed 26 are well known to those skilled in the art, they will not be described in detail herein. Because boom cab 22 rotates with boom 24, the operator is always in a position to view the location of blast head assembly 11 and actuating assembly 12. A control panel for operating various elements of the sub-assemblies can be portable, with electrical wires connecting it to the control devices, so that the operator can leave the boom cab and control the boom movement from a better vantage point, if desired.

The boom includes proximate end 29 pivotally secured to boom mount 25 enabling boom 24 to pivot through a number of vertical planes substantially perpendicular to the plane of movement for the rotating bed 26. For pivoting boom 24 through these vertical planes, two spaced-apart hydraulically operated boom hoist cylinders 58 are provided on the boom mount 25 to raise and lower the boom as desired. The lower end of each hoist cylinder 58 is pivotally fixed to the boom mount 25 with the upper end of the cylinder being pivotally secured to bracket 59 on a lower portion of boom 24 so that as the cylinder is operated to raise and lower boom 24 it can move to accommodate the change in position of boom 24 relative to boom mount 25.

In addition to being movable with rotating bed 26 and pivotable through any number of vertical planes as explained above, boom 24 is of the telescoping type which allows the boom to be extended or retracted as needed, including while blasting a swath across surface 8 being treated. This telescoping feature permits the boom and its blasting machine or head to be moved through a series of vertical paths to blast or clean vertical swaths along surface 8, as can be seen in viewing FIG. 1A, where there is shown in partial view boom 24 in a retracted position. Boom 24 can be initially moved into position by rotating and pivoting the boom toward the surface to be treated, and then be lowered or raised by the action of cylinders 58 causing the boom to move through a vertical working path or swath. Simultaneously with these movements, the boom is retracted or extended so that blasting head assembly 11 is always maintained moveably engaged with the surface being treated. Otherwise, when the boom is pivoted downwardly blasting machine 28 would be pressed against surface 8 to the extent where eventually the boom could not be moved any further in the same vertical direction. Once a vertical swath is cut boom 24 is rotated to an adjacent or other position, raised and then extended to press the blast head assembly 11 against the surface being treated in preparation for a cut in another vertical plane. Subsequently, the boom can be lowered as before to cut another vertical swath on the surface adjacent the previous swath. This can be done seriatim, one swath after another, until the entire surface is cleaned. Where a circular or other convoluted surface is employed there may be limits through which the boom can be rotated and still maintain the vertical swath when moved in the vertical direction. As can be seen in FIG. 2, there is shown a range in phantom lines through which a number of vertical swaths can be cut in a single location for the entire assembly 10. After the surface has been cleaned through a given range, the truck can be moved to a new location and the operation repeated.

Movements of boom 24 as described above are typically not sufficient for maintaining the blasting zone in a proper disposition relative to surface being treated. The blast head and actuating assemblies 11, 12 include a number of elements to compensate for changes in boom position which would otherwise tend to disengage blast head assembly 11 from the surface. The operation of these elements is such that as the operator starts and controls downward, upward or other movement of boom 24 through a working path by actuation of hoist cylinder 58, the correct disposition of the blasting machine 28 will be maintained by the sensing and control mechanisms.

Figure 1B:
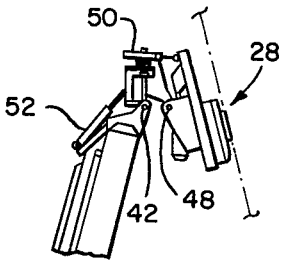
FIG. 1B is a partial side view of the apparatus shown in FIG. 1 with the boom in an extended position and with the blasting machine engaged with a surface angled to the vertical.
Figure 1A:
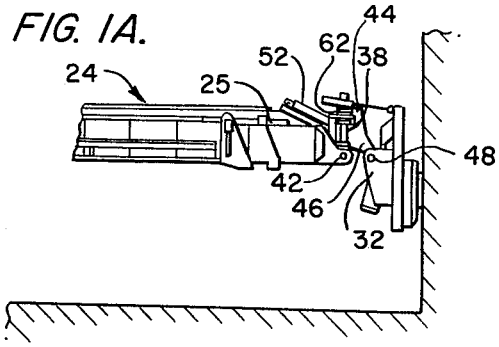
FIG. 1A is a partial view of the apparatus shown in FIG. 1 with the boom in a retracted position and horizontally positioned.
Figure 8:
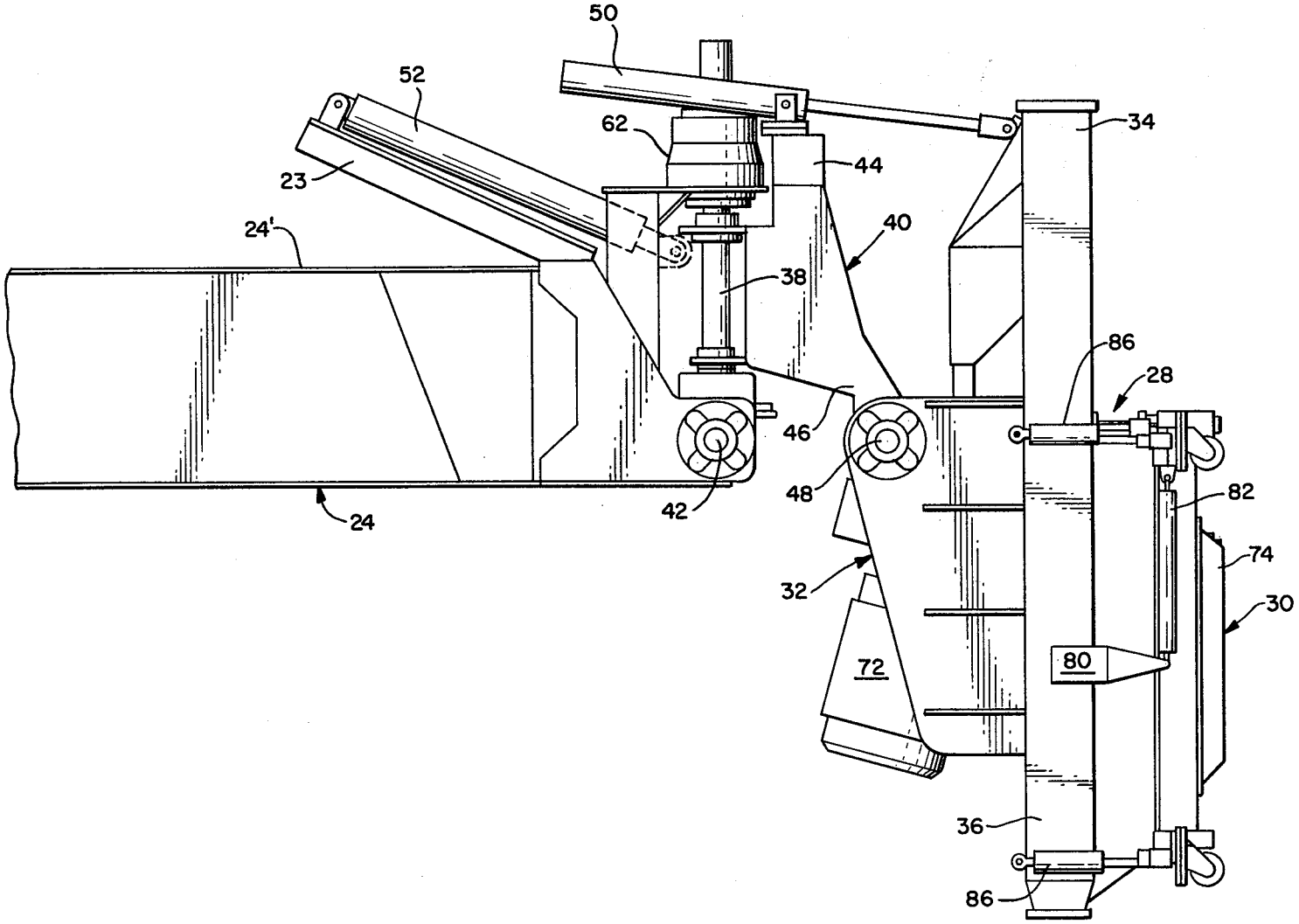
FIG. 8 is an enlarged view of the blasting machine and distal end of the boom.

The apparatus includes the blasting machine 28 having a blasting zone 30 in the front portion thereof for engaging the surface to be treated. As can be seen more clearly in FIGS. 4, 5 and 8, the blasting machine 28 further includes a rear portion 32 having an upper portion 34 and a lower portion 36 which extend, respectively above and below the blasting zone 30. For holding the blasting machine 28 to the distal end 27 of boom 24 in a vertically-pivotable mode, the lower end of shaft 38 is pivotally secured above bracket 42 on boom 24. Bracket 40 includes a portion journalled about shaft 38 which allows the bracket 40 to rotate about the distal end 27 of boom 24 with the shaft 38 serving as the axis of rotation. Bracket 40 further includes an upper arm 44 and a lower arm 46. The rear portion 32 of blasting machine 28 is pivotally secured to a lower arm 46 of bracket 40 at second pivot 48. Two spaced apart tilt cylinders 50 are each fixed to upper arm 44 to tilt blasting machine 28 about second pivot 48. See FIG. 3A. With this set of linkages the blasting machine 28 can independently pivot about pivot point 48 relative to bracket 40 which in turn pivots about first pivot 42. Also, bracket 40 permits the entire blasting machine 28 assembly to rotate about shaft 38. With this set of linkages along with the movements of the boom discussed above, blasting machine 28, and particularly the blasting zone 30, can be maintained in the correct disposition relative to the surface being cleaned regardless of the angle of the surface as can be seen in FIG. 1B or the position of the boom as can be seen in FIG. 2.

For maintaining blasting machine 28 in the desired position a series of cylinders, sensors and actuating mechanism are incorporated with the articulated assembly discussed above to rotate or pivot the various elements of blast head assembly 11 and actuating assembly 12 as needed. Included within this system is a leveling cylinder 52 which has one portion journalled to shaft 38 and another portion secured to the distal end 27 of boom 24. More specifically, the distal end 24 includes a beam 23, extending rearwardly at an acute angle to the distal end of boom 24 along backside 24' on thereof, which provides support for the cylinder 52 to keep it in a proper disposition for actuation of shaft 38. Cylinder 52 is a slave cylinder operatively connected to master cylinder 54 which is located at the bottom of boom 24 as can be seen in FIG. 1. In this way movement of boom 24 upwardly or downwardly under the action of boom hoist cylinders 58 will produce a corresponding compression or retraction of the piston within the master cylinder 54. This in turn creates a similar corresponding action on the slave cylinder 52 to pivot blasting machine 28 about pivot 42 and thereby maintain the correct position of blasting machine 28 in vertical plane to compensate for the change of positioning of boom 24. For example, as can be seen in FIG. 1, if the boom 24 were lowered under the action of boom hoist cylinders 58 the master cylinder 54 wouuld cause its piston to move in such a way that the slave cylinder 52 would draw the shaft 38, and along with it bracket 40 and blasting machine 28 to which the shaft is connected, toward backside 24' of boom 24 through an arc corresponding to the arc created by the action of the boom hoist cylinders 58 in pivoting boom 24 about its proximate end. In this way the desired disposition of blasting machine 28 is always maintained relative to boom 24 as it is moved through a vertical swath.

Each of tilt cylinders 50 has one portion pivotally secured to upper arm 44 and one end of tilt cylinder piston rod 49 for each cylinder 50 pivotally secured to the upper portion 34 of blasting machine 28. This enables blasting machine 28 to be rotated about second pivot 48 to adjust to the blasting head for those surfaces that are angled to the vertical, an example of which is shown in FIG. 1B. Thus, even though the surface to be treated may change in its vertical orientation during the length of travel of the boom 24 through the swath the blasting zone 30 can be maintained in the proper orientation relative to the surface by actuation of tilt cylinder 50 as the boom is retracted and pivoted downwardly during the movement through the vertical swath.

Hydraulic motor and gear reducer 62 is fixed to the top of shaft 38 and connected to bracket 40 to rotate bracket 40 about the shaft. Because blasting machine 28 is fixed to bracket 40 at second pivot 48, movement of the bracket 40 by hydraulic motor 62 results in corresponding rotational movement of the blasting machine 28. This facilitates adjusting the position of the blasting head horizontally about the vertical axis defined by shaft 38 relative to boom 24. As can be seen from FIG. 2, as boom 24 is rotated from the center position where the blasting machine is in the same plane as boom 24 toward another position as shown in phantom lines, the blasting machine can be rotated to maintain constant engagement of blasting zone 30 against the surface being treated. As boom 24 is rotated to a new position to cut another swath, the orientation of blasting machine 28 can be adjusted by actuation of motor 62 to compensate for the effect of boom movement which might otherwise disengage machine 28 from the surface.

The cylinders discussed above for operating the various elements of the assembly, moving the blasting machine through swaths and moving the blasting machine to other areas of the surface for other operating modes, are incorporated with a system for sensing the position of the blasting machine and actuating the appropriate cylinders to compensate for any tendencies of the machine to move away from the desired orientation of the machine relative to the surface being treated. Details of the hydraulic and electrical systems for controlling these cylinders will be discussed herein; but before describing these circuits it may be more helpful to elaborate on the structure of the blasting machine so that its operation in treating the surface to be cleaned can be appreciated.

Figure 4:
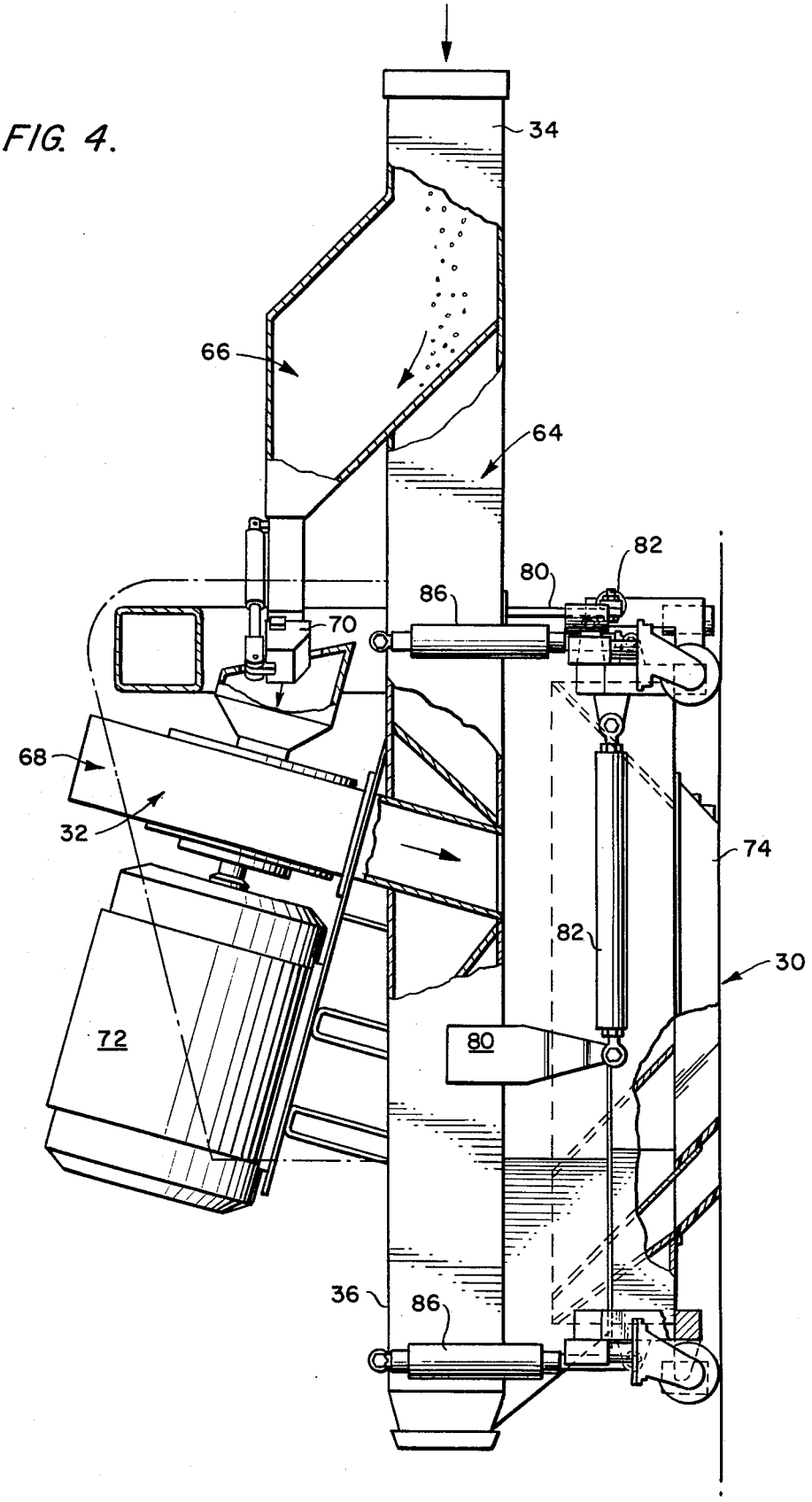
FIG. 4 is an enlarged, partial view of the blasting machine carried on the boom with portions removed to expose some of the internal elements.

As shown in FIG. 4, an elevator housing 64 extends across substantially the entire height of blasting machine 28. Shot hopper 66 communicates elevator housing 64 to blasting wheel 68 through shot valve 70. The shot propelled by wheel 68 against the surface being treated is collected in the bottom portion of elevator housing 64 and is delivered to shot hopper 66 by an elevator system not shown in FIG. 4 but well known to those skilled in the art. The shot employed is then metered through shot valve 70 to blasting wheel 68 where is is propelled under high speed toward blasting zone 30 for treating the surface. After rebounding from the surface being treated the shot is directed to the bottom portion of the elevator housing 64 for reuse. Electrical motor 72 is used as the driving force for the blasting wheel as shown in FIG. 4, although other driving mechanisms could be employed. In this particular machine there are two blasting wheels 68 with each having its respective electric motor 72. The blasting wheels and motor assembly are located one behind the other as shown in FIG. 4 with the delivery paths being oriented to achieve maximum effect of the shot on the surface being cleaned.

Blasting zone 30 is surrounded by an elastomeric seal 74 extending outwardly from the front surface of the blasting machine 28. When the machine is oriented properly the seal is pressed against the surface being treated such that as the shot is delivered by the blasting wheel 68 it will not escape into the surrounding atmosphere. This keeps leakage of the shot as well as the dust and other debris removed by the cleaning process from escaping into the surrounding area. Floating frame 76 is carried on the front portion of blasting machine 28 in moveable relationship therewith to communicate the blasting wheel shot path with the blasting zone 30, as well as provide a support for elastomeric seal 74 about the blasting zone as described above.

Figure 5:
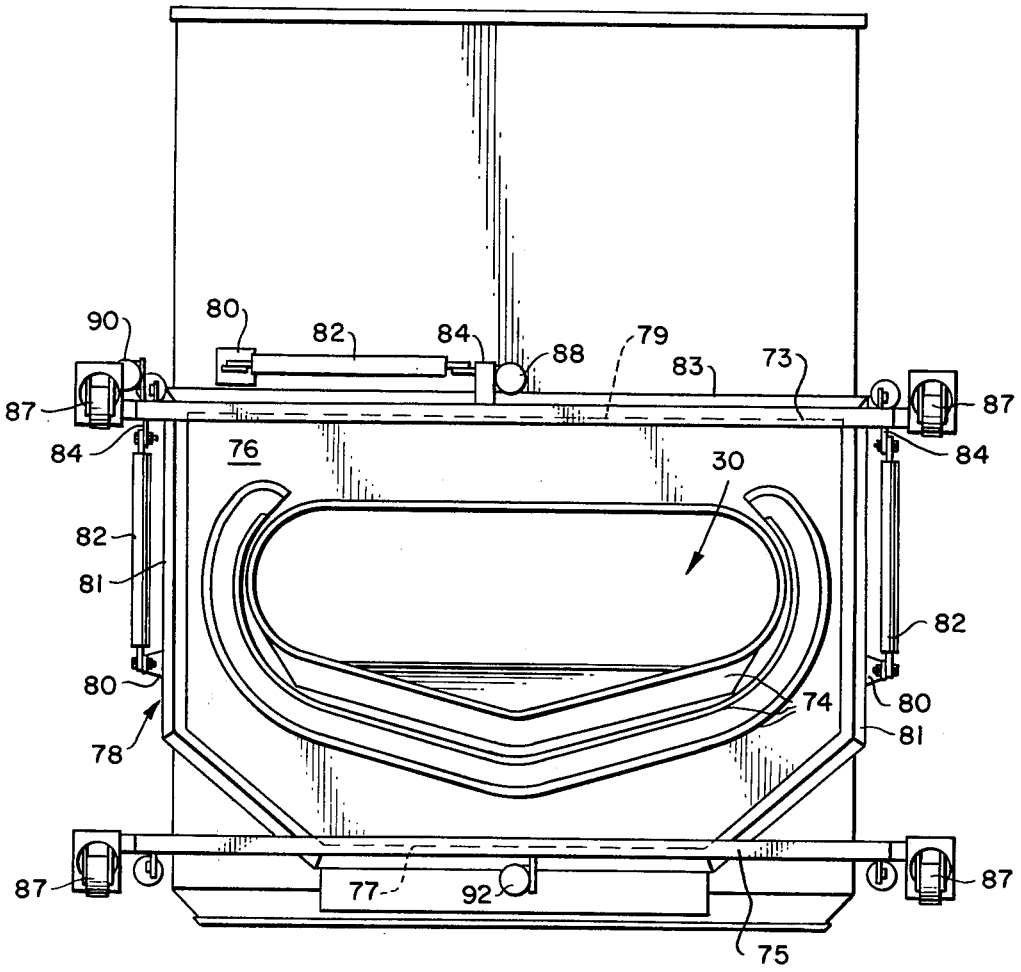
FIG. 5 is an enlarged, front view of the blasting machine.

Fixed frame 78 is an irregular hexagon in configuration with each side having a dimension greater than that of a corresponding side on floating frame 76 which is also hexagonal in shape. This allows for movement of floating frame 76 within fixed frame 78. Floating frame 76 is mounted on fixed frame 78, also extending from the front portion of blasting machine 28, by three locating links 82 in a manner which allows relative movement between floating frame 76 and fixed frame 78. Extending spaced from one another on three adjacent sides, i.e., each vertical side 81 and upper horizontal side 83 as shown in FIG. 5, about the periphery of fixed frame 78 are three locating link brackets 80. As can be seen in FIGS. 4 and 5 each bracket is fixed to elevator housing 64 about the periphery of fixed frame 78 approximately midway along each side of the fixed frame. Each locating link has one end pivotally secured to locating bracket 80 with the other end pivotally secured to a floating frame bracket 84 fixed adjacent a corner of floating frame 76.

Floating frame 76, as can be seen in FIG. 5, includes upper horizontal side 79 and lower horizontal side 77, an upper rod 73 and lower rod 75 are attached respectively to front face of floating frame 76 at its intersection with upper side 79 and lower side 77. The ends of rods 73 and 75 extend beyond the vertical sides 81 of fixed frame 78. Four air cylinders 86 are connected between floating frame 76 and blasting machine 28. As shown in FIGS. 4 and 5 there is provided one cylinder at each end of rods 73, 75 with one end of the cylinder pivotally secured to any convenient location on blasting machine 28 and the other end pivotally secured to a convenient bracket on rods 73, 75. These air cylinders by being located in a manner described preload floating frame 76 relative to fixed frame 78, and ultimately the remainder of blasting machine 28, to maintain floating frame in a normal position as shown until acted upon by forces which would otherwise tend to overcome the actions of the air cylinders and move floating frame 76 toward or away from blasting machine 28.

Casters 87 are also located adjacent each corner of floating frame 76 on the ends of rods 73, 75 to extend beyond the outermost surface of elastomeric seal 74 when it is not compressed. By having the casters mounted in this manner damage to the elastomeric seal 74 is substantially prevented for those situations where force placed on the blasting machine would tend to unduly compress the elastomeric seal and possible irreparably damage the seal.

A series of sensors are located about the periphery of floating frame 76 for sensing movement of the floating frame relative to fixed frame 78 or blasting machine 28, and thus of the position of the face of the blasting zone relating to the surface being treated. Alternatively, the sensors may be positioned to contact the surface being treated and detect its relative position to that of the face of the blasting zone. The sensors are incorporated in a system for adjusting the position of blasting machine 28 to compensate for tendencies of machine 28 to move from the proper orientation as demonstrated by the signals produced by the sensors. A first sensor 88 for sensing boom extension or rotation is mounted approximately in the center of upper portion of floating frame 76 and has one end fixed to floating frame 76 and the other end fixed to the fixed frame. It should be noted that this first sensor, by being located in the center of the floating frame, is located essentially at the intersection of the horizontal and vertical control or pivoting axes of the floating frame. As a result the sensor 88 will primarily sense movement of the floating frame relative to the fixed frame as the boom is either moved toward or away from the surface to be treated. In other words, it is not particularly sensitive to rotation about shaft 38 or tilting of the blasting machine about second pivot 48. Thus, sensor 88 will be sensitive to extension and retraction in the first mode of operation, and rotation of boom 24 in the second mode of operation as described above.

A second sensor 90 is located at or near one corner of floating frame 76, i.e., substantially away from the vertical control axis of the floating frame, with one end fixed to the floating frame and another end fixed to the fixed frame. The position of second sensor 90 falls essentially in the plane of the horizontal axis of second pivot 48 and is displaced substantially away from the vertical control axis of the floating frame, i.e., the axis of shaft 38. In this manner the sensor 90 detects movement of floating frame 76 about the axis of shaft 38 which in this case is rotation of blasting machine 28 about shaft 38. A third sensor 92 is located at the bottom portion of floating frame 76 approximately midway between the corners thereof. In this position the third sensor 92 lies essentially in the same vertical plane as sensor 88, but is substantially displaced from the plane of the horizontal axis of tilt rotation, of the blasting head, i.e. pivot 48. Sensor 92 located in this manner will be sensitive to the movement of blasting machine 28 about the tilt axis of rotation of pivot 48 caused by changes in the configuration of the surface being treated as blasting machine 28 is moved along a working path by boom 24.

Figure 6:
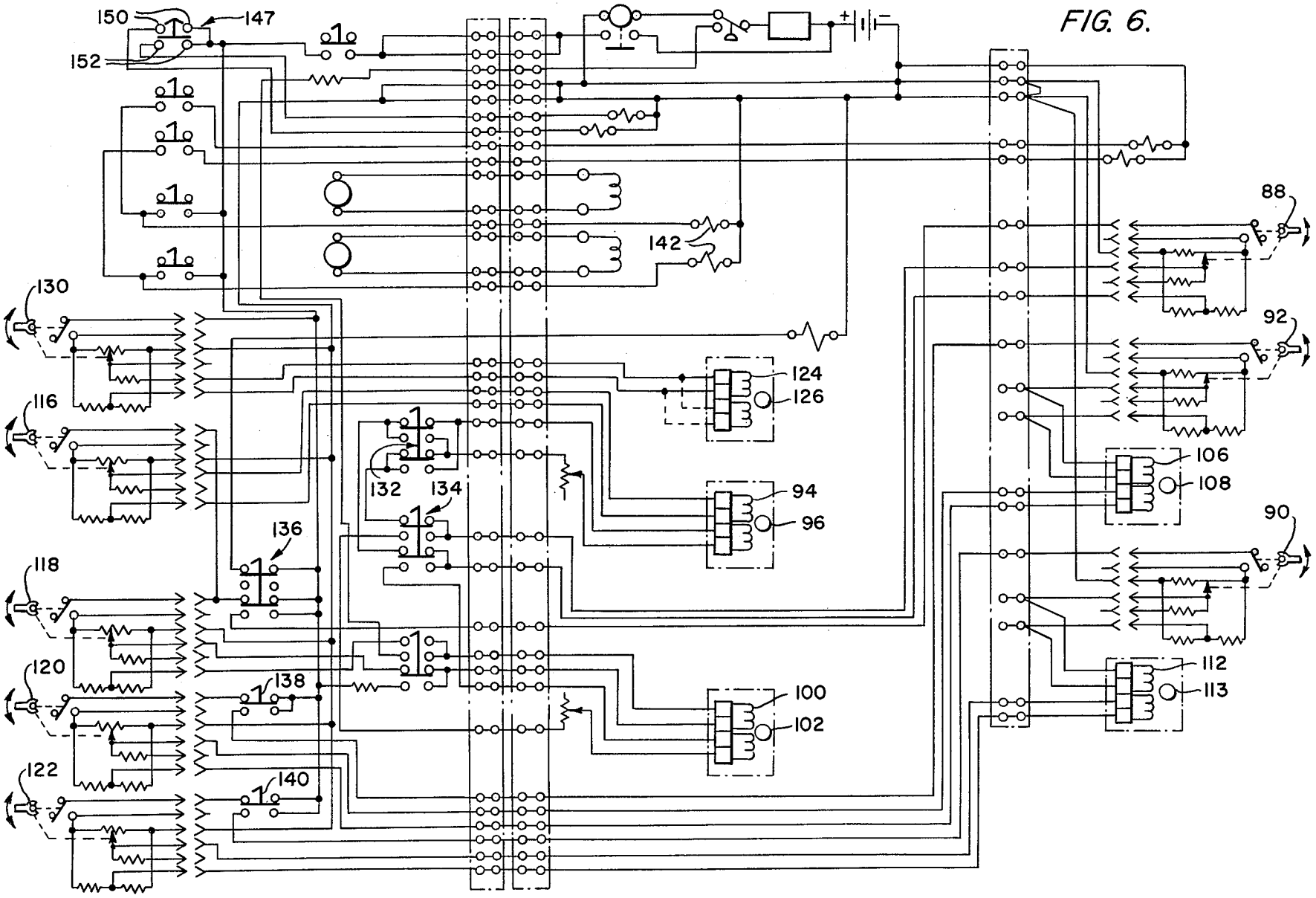
FIG. 6 is a schematic of the electrical system which forms part of a control system to operate the apparatus.

The electrical system for controlling the orientation and position of blasting machine 28 is shown in schematic in FIG. 6. The system is integrated with sensors 88, 90, 92 and the hydraulic system of FIG. 7 to compensate for movement of blasting machine 28 away from a correctly engaged position with respect to the surface being treated. Provision is made in the circuitry to deactivate the automatic controls and replace them with manual controls for those modes of operation where manual control may be more efficient or otherwise desirable. In the preferred embodiment the sensors are mechanically sensitive to displacement by compression or extension from *the normal position,* i.e. where the plane across the open face of the blasting zone is more or less parallel to the surface being treated, and are integrated with an electrical circuit to emit a signal corresponding to the direction of movement from the normal position as well as the extent of displacement. In the normal position the signal corresponds to the correct orientation of blasting machine 28 for each respective sensor.

For each sensor there are a set of coils or other motive apparatus to operate a valve or hydraulic motor in the hydraulic circuit which will drive the piston and cylinder assemblies in a direction depending on a signal received by the coil. More specifically, sensor 88 is connected to boom rotation coils 94 through rotation-extension control mode switch 134. Sensor 88 is also connected to boom extension coils 100 through rotation-extension control mode switch 134 as well as rotation polarity switch 132. Rotation-extension control mode switch 134 is also connected between sensor 88 and boom rotation coils 94. In this manner the desired mode of operation can be chosen by simply moving the control mode, rotation-extension switch 134 between the rotation mode and the extension mode. Where the rotation mode is chosen the boom rotation coils 94 are then placed in the circuit in connection with sensor 88 and extension coils 100 removed; where the extension mode is chosen the rotation coils are removed from the circuit while the extension coils 100 are placed in the circuit and activated by sensor 88. Rotation polarity switch 132 enables the operator to choose between left or right side for sweeping in an arc. Thus, as boom 24 is lowered or moved through an arc, sensor 88 will cause rotation of boom 24 to adjust for movement of blasting machine 28 toward and away from the surface. On the other hand where the boom extension mode is chosen, sensor 88 actuates coils 100 and causes boom 24 to retract as it is moved downwardly in a vertical swath.

Similarly, tilt valve coils 106 are activated by sensor 92 depending on the amount of rotation of blasting machine 28 about second pivot 48. Where surface configuration includes portions angled to the vertical, the sensor 92 will be moved from its normal position because of the tendency of blasting machine 28 to rotate about pivot 48 when confronted with such an angled surface. This movement is translated into an electrical signal as indicated by the circuitry of FIG. 6 to activate tilt valve coils 106 which energizes tilt valve motor 108 to drive tilt valve 110. Operating tilt valve 110 in this manner effects delivery of hydraulic fluid to the tilt cylinders for moving the blasting machine 28 in the appropriate direction about pivot 48. In this manner changes in the surface which would otherwise cause disengagement of blasting machine 28 are compensated for to maintain the correct orientation and thereby maintain proper engagement of machine 20 with the surface.

Yaw valve coils 112 are connected to sensor 90 and energized thereby by an electrical signal corresponding to the mechanical movement as changes in the surface tend to rotate blasting machine 28 about its vertical axis. Depending on the movement of the sensor the coils are energized to activate yaw valve motor 113 which in turn operates yaw valve 114 to move hydraulic motor in clockwise or counterclockwise direction so that the blasting machine 28 will be swiveled to a position to compensate for tendencies to move away from the surface due to changes in the surface configuration.

What has been described above is an automatic system for compensating for changes in the surface configuration so that the blasting machine will always be maintained in the correct disposition relative to the surface being treated. However, there may be occasions where parts or all of the automatic system are not desirable. For these situations manual controls can be used to move the blasting head through the desired working path.

Manual boom rotation controller 116 is provided and connected to boom rotation coils in the same manner as sensor 88. Included in this circuit intermediate boom rotation coils 94 and manual boom rotation controller 116 is boom extension or rotation manual-auto switch 136. If it is desired to operate the boom extension or rotation manually the switch 136 can be placed in the manual mode to implement the manual operation and deactivate the automatic operation. Similarly, a manual boom extension controller 118 is provided and connected to a boom extension coils 100 through boom extension or rotation manual-automatic switch 136. Thus the manual boom rotation controller 116 and manual boom extension controller 118 both are connected to their respective coils through boom extension or rotation manual-automatic switch 136. In turn the switch 136 is connected to the respective coils through rotation-extension mode control switch 134. In this way once the desired control mode is chosen, i.e. rotation or extension, through operation of switch 134, and the manual system is chosen through operation of switch 136, manual control 116 is employed when the rotation mode is activated and the controller 118 when the extension mode is in operation.

A manual tilt controller 120 is connected to coils 106 through tilt manual-automatic switch 138. Similarly, manual yaw controller 122 is connected to yaw coils 112 through yaw manual-automatic switch 140. In both of these circuits the activation of coils 112 and 106 operate similarly in that the respective tilt 138 and yaw 140 switches are operated to deactivate the automatic sensing system and incorporate the manual system operated by the respective controllers 120 and 122. Other elements of the electrical system relate primarily to the control of blasting machine 28 as well as to provide power to the remainder of the system for both the automatic and manual modes of operation. As details of this system can be readily appreciated by one skilled in the art in viewing the circuit in FIG. 6 further operation of these elements will not be elaborated herein.

Figure 7:
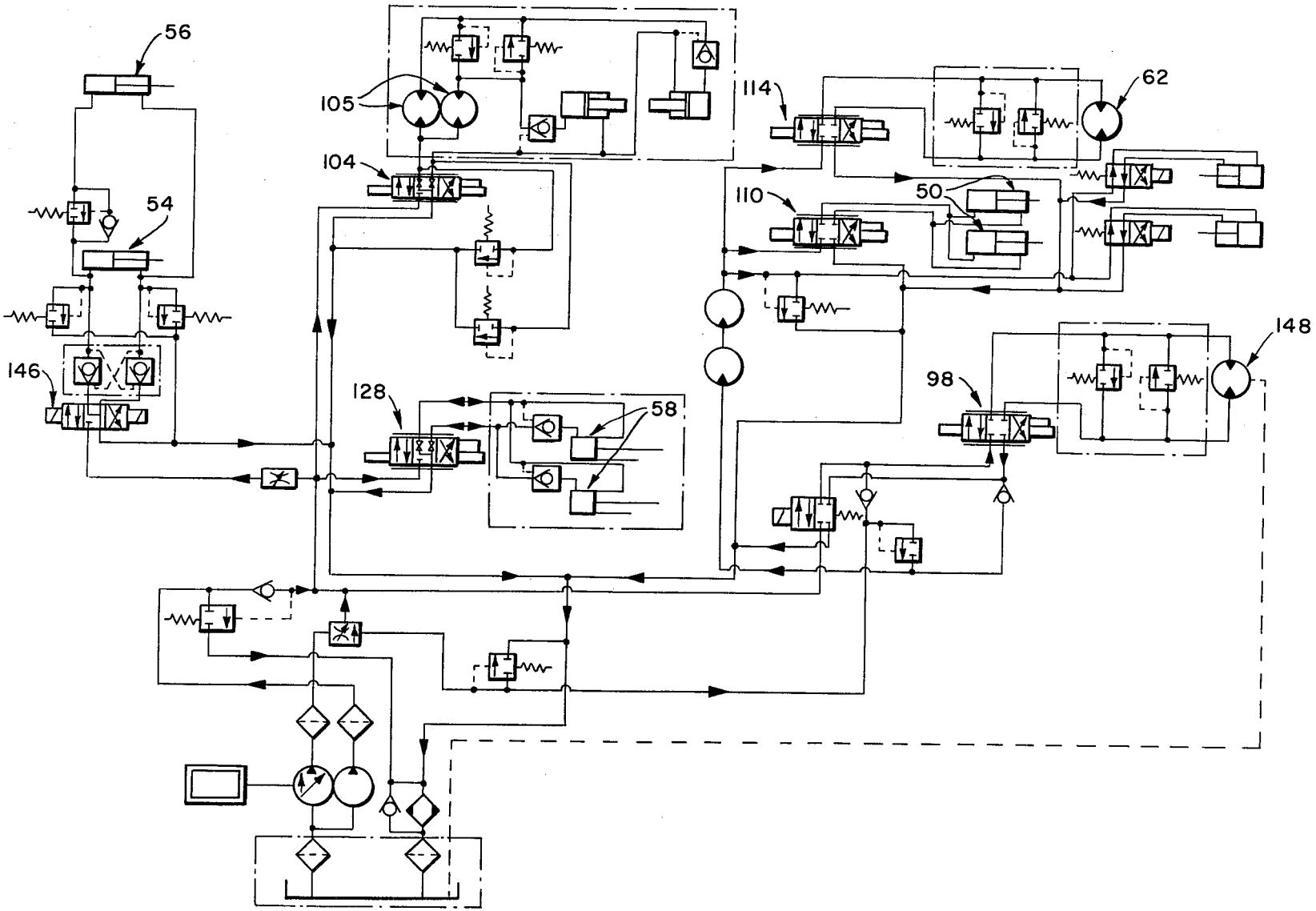
FIG. 7 is a schematic of the hydraulic system which forms part of a control system to operate the apparatus.

Referring to FIG. 7, there is shown a schematic of a hydraulic system incorporating the various valves and piston and cylinder means discussed above. Because such a diagram is readily understood by those skilled in the art, all of the details of the diagram will not be explained but only so much as enhances the operation of the various sub-assemblies discussed at length above.

Boom rotation valve 98 actuated by boom rotation valve motor 96, as shown in schematic, connected to hydraulic motor 148, and can be moved in an infinite number of positions. As shown, valve 98 is in a neutral position where the hydraulic motor would be inactivated rendering the boom substantially immobile until reactivated under the action of the sensor 88 or manual controller 116. As valve 98 is moved in one direction, for example to the right as shown in FIG. 7 hydraulic motor 148 is caused to move in one direction pivoting the boom toward the surface to be cleaned. As valve 98 is shifted to the left the flow of fluid within the circuit is reversed causing the motor 148 to rotate in an opposite direction and move the boom 24 away from the surface. The speed of rotation is dependent upon the displacement of the valve. Similarly, tilt valve 110 is an infinite-position valve connected to tilt cylinders 50 to pressurize either side of the pistons within the cylinders depending on the mode of operation. For example, where manually or automatically tilt valve 110 is moved to the right as shown in FIG. 7 the right side of the pistons in cylinders 50 will be pressurized and drive the piston rods to the right thereby pivoting blasting machine 28 about pivot 48 and tilting it forward. Movement of valve 110 to the left pressurizes the right side of the pistons driving the piston rods towards the left thereby pivoting blasting machine 28 about pivot 48 in the opposite direction and tilting it upwardly. The speed of movement is again dependent upon the displacement of the valve.

Yaw valve 114 is also an infinite-position valve to operate hydraulic motor 62 which swivels bracket 40 with blasting machine 28 about the vertical axis defined by shaft 38. The direction and speed of rotation is a function of the position of valve 114 which operates in a manner similar to valve 98; accordingly it need not be reiterated here.

Boom extension valve 104 operates hydraulic bidirectional cylinders 105 to extend or retract the boom assembly depending on the position of the valve. As with the other valves, valve 104 is an infinite-position valve where movement between the end positions changes the direction and rate of flow of the fluid to move the bidirectional cylinders 105 which in turn effect extension or retraction of the boom 24 in a known manner.

For raising and lowering boom 24, hydraulic cylinders 58 are operated by hoist valve 128. Movement of valve 128 to the right effects hydraulic fluid flow to drive pistons in the cylinders 58 to the left and retract the piston rods causing the boom to be lowered. Movement of valve 128 in the opposite direction to the left effects hydraulic fluid flow to drive pistons in cylinders 58 to the right, extending the piston rods and resulting in the boom being raised. Thus, by positioning of valve 128 the raising and lowering of the boom can be controlled.

Finally, levelling valve 146, operated by solenoids 142 and 144, provides for charging master cylinder 54 and slave cylinder 56 to place shaft 38 in the vertical position which is preferred. Actuation of levelling switch 147 between forward and backward mode 150, 152 provides a means to move shaft 38 to a vertical disposition. Once in the proper position slave cylinder 56 will move in a direct relationship with master cylinder 54 to maintain levelling of machine 28. For example, when the boom is moved upwardly the piston rod in master cylinder 54 will be retracted due to the upward movement of boom 24 while the piston rod of the slave cylinder 56 will be extended correspondingly to maintain levelling of blasting machine 28. During downward movement of boom 24 the piston rod in master cylinder 54 will be extended and that of slave cylinder 56 will be retracted.

The operation of blasting machine 28 will be described in connection with the electrical circuit as well as the hydraulic circuit so that the interaction can more readily be appreciated. After apparatus 10 is moved adjacent the surface to be treated, assuming that the machine can be placed sufficiently far away to allow full rotation of boom 24 in a retracted position, to a position adjacent the surface, the outriggers are then extended to hold the apparatus in the correct position for operation and cleaning of the surface. Once the electrical circuit has been placed in operation by moving the master switch 149 to the on position, the manual hoist controller 130 is actuated to rotate the boom upwardly to the desired position or angle relative to the horizontal plane. This is accomplished by energizing coils 124 which in turn actuate motor 126. Motor 126 then drives hoist valve 128 into a position where the hydraulic fluid is driven to the cylinders to extend the position rods outwardly thereby moving boom 24 to an upward position.

Control mode rotation or extension switch 134 is placed in the extension mode. Once the boom has been raised or hoisted, boom extension or rotation manual-auto switch 136 is placed in the manual mode and rotation or extension control mode switch 134 is moved to the extension mode. Controller 118 is then moved manually to extend boom 24 toward a position adjacent the surface being treated. Operation of controller 118 energizes coils 110 to drive motor 102, in turn, motor 102 moves valve 104 to a position which causes hydraulic motors 105 to extend the boom 24. Once the desired extension has been achieved, controller 118 is moved to a neutral position where coils 100 are deactivated thus stopping movement of motor 102 and allowing valve 104 to revert to its normal position.

Where the surface being treated is not flat or does not lie solely in a vertical plane, once blasting machine 28 is located near the surface to be treated by extension or rotation and hoisting other adjustments will be made to insure that blasting machine 28 is in the correct disposition relative to surface 8 under the action of the sensors, 88, 90, 92. When blasting a vertical path the mode of operation is one where the boom will be moved downwardly until the action of hoist cylinder and the desired relationship between blasting machine 28 and the surface being treated is achieved through the action of sensors 88, 92, and 90. This is accomplished by placing switch 136 into the automatic boom extension mode. Similarly switches 138 and 140 should be moved to the automatic mode removing manual tilt controller 129 and manual yaw controller 122 out of this circuit and placing boom extension sensor 88, tilt sensor 92 and yaw sensor 90, into operation. The manual hoist controller 130 is then moved to drive the hoist cylinder 58 to retract the piston rod thereby rotating the boom downwardly. During this rotation sensor 88 detects a tendency of the floating frame 76 to be pressed against fixed frame 78 as a result of this downward motion. Accordingly, boom extension coils 100 will be activated to energize motor 102 and move valve 104 to continually retract the boom, as described above, and compensate for downward movement of boom 24 which would otherwise tend to jam against the surface to be treated.

Should the surface configuration change relative to horizontal axis, and vertical axis, this change will be sensed by movement of tilt sensor 92 and yaw sensor 90. As a result of a change in the vertical direction, for example toward the vertical plane away from the angle as shown in FIG. 1B, sensor 92 will detect movement of floating frame 76 toward a fixed frame 78. This will result in a signal to coils 106 to drive motor 108 to move valve 110 in a position to force pistons 49 and their piston rods outwardly thereby rotating blasting machine 28 about second pivot 48 to adjust for the change in surface configuration. Similarly, should the surface configuration change from the plane of the horizontal axis, yaw sensor 90 will detect the movement of floating frame 76 relative to a fixed frame 78 pivoting essentially about the vertical axis defined by shaft 38. This will produce an electrical signal to energize coils 112 and activate motor 113 to drive yaw valve 114 in a position where hydraulic motor will swivel the bracket 40 along with blast head 28 about the vertical axis until the correct relationship between fixed frame 76 and the floating frame 78 is achieved.

Figures 3, 3A:
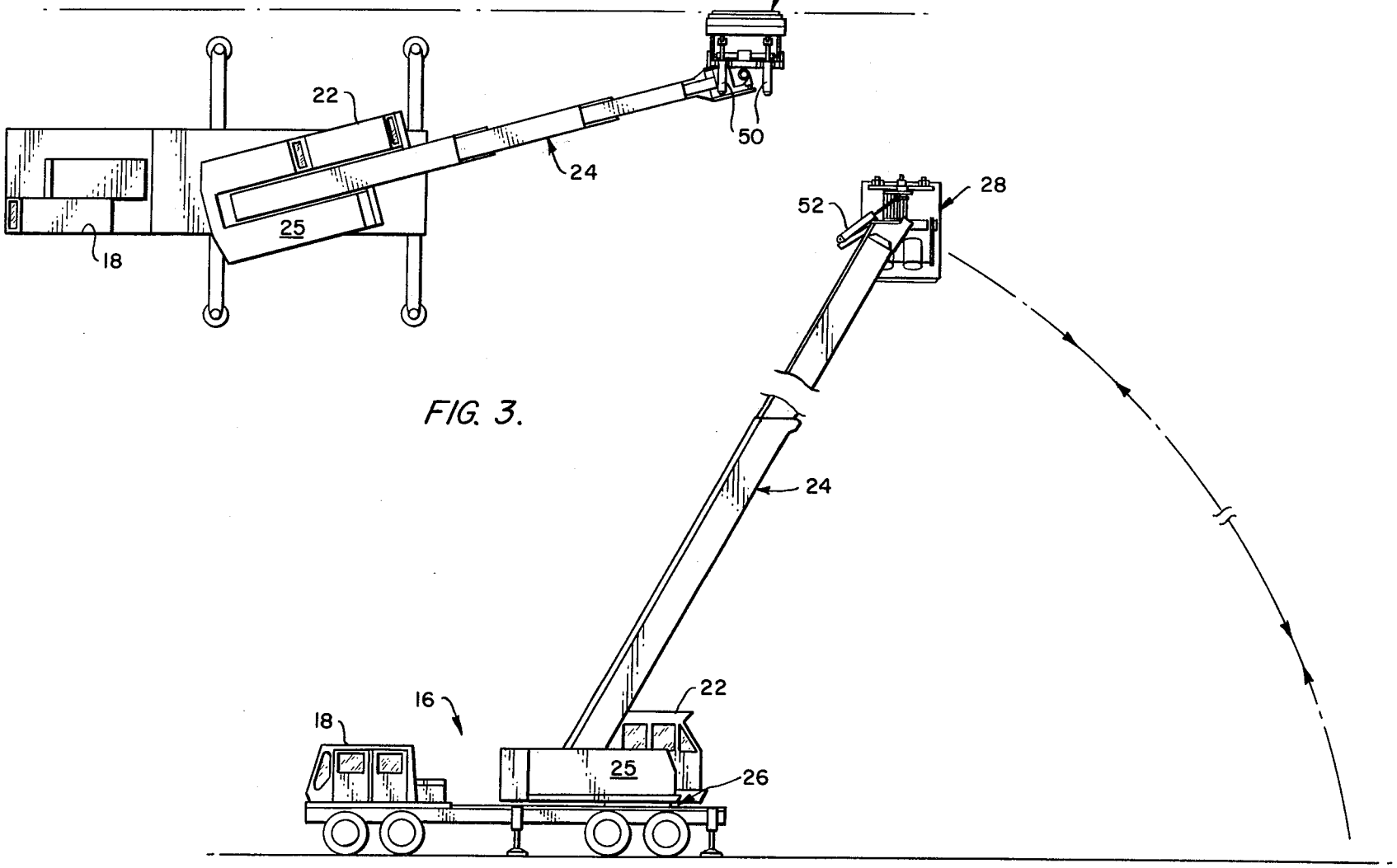
FIG. 3 is a side view of the apparatus with an arc across a surface being shown to indicate a blasting path.
FIG. 3A is a plan view of the apparatus shown in FIG. 3 in a second mode of use.

In the other mode of operation, where the truck and its related parts cannot be placed sufficiently far from the surface being treated to allow the boom to be moved as described above, boom 24 can be rotated through an arc as shown in FIG. 3. In this situation boom control mode rotation-extension switch 134 is moved to the rotation mode in which case manual controller boom extension 118 is removed from the system while controller 116 for boom rotation is integrated into the system. In addition, sensor 88 acts to detect boom rotation rather than boom extension. To initiate action the boom is placed in the desired position as described above. But rather than retract the extended boom as it moved downwardly, the boom is swept through an arc under the action of the hoist cylinder 58 and rotated toward and away from the surface being treated as it moves through that arc automatically under the action of sensor 88 with other elements of the electrical and hydraulic system. For example, where a cylindrical surface was being cleaned the surface tends to bend away from blasting machine 28 as it moves downwardly through the arc. This downward movement is initiated through operator movement of controller 130; as the downward movement occurs sensor 88 detects the movement of the surface away from the truck as a result of the tendency of floating frame 76 to move away from fixed frame 78. The resulting signal is sent to coils 94 which energize motor 96 to drive boom rotation valve 98 to a position causing hydraulic motor 148 to rotate the boom closer to the surface in adjusting to changes in surface configuration. With regard to the tilting and yaw adjustments these operate the same way as described above with respect to the other mode of operation and need not be reiterated here.

It is claimed:

1. Apparatus for treating a surface comprising a land vehicle including a truck, a boom carried by said truck, said boom having an end portion proximal to said truck and a distal end portion remote from said truck, a blasting member positioned on said distal end portion, means to pivot said boom with respect to said truck to raise or lower said blasting member, means to move said boom transversely, said blasting member having an opening for delivery of an abrasive therethrough to contact an adjacent surface to be treated, said blasting member being pivotally mounted on the distal end of said boom for rotation about two axes one substantially perpendicular to another, sensing means for sensing the position of said opening with respect to said surface, and adjusting means operatively associated with said sensing means for maintaining said opening closely adjacent said surface in response to signals from said sensing means indicating a change in position of said opening with respect to said surface.

2. The apparatus according to claim 1 wherein said boom includes an extendable boom capable of extension and retraction and said means for adjusting the extent of retraction or extension of said extendable boom, a shaft at said distal end portion defining one of said axes, holding means for holding said blasting member on said distal end portion, means for moving said holding means on said shaft, a pivot on said blasting member defining the other of said axes, and means for pivoting said blasting member about said pivot, to maintain said opening of said blasting member adjacent said surface for delivering abrasive thereto.

3. Apparatus for treating a surface comprising a support, a boom carried by said support, said boom having an end portion proximal to said support and a distal end portion remote from said support, a blasting member positioned on said distal end portion, means to pivot said boom with respect to said support to raise or lower said blasting member, means to move said boom transversely, said blasting member having an opening for delivery of an abrasive therethrough to contact an adjacent surface to be treated, said blasting member being movably mounted on said boom, said boom including an extendable boom capable of extension and retraction, adjusting means for adjusting the extent of retraction or extension of said extendable boom, a shaft at said distal end portion, holding means for holding said blasting member on said distal end portion, means for moving said holding means on said shaft, a pivot on said blasting member, and means for pivoting said blasting member about said pivot, to maintain said opening of said blasting member adjacent said surface for delivering abrasive thereto;

a first sensor for sensing the position of said opening toward and away from the surface to be treated, and means for operating said adjusting means to extend and retract said boom in response to signals from said first sensor;

a second sensor for sensing the position of the horizontal axis of said opening with respect to said surface to be treated and means for rotating said holding means and said blasting member about said shaft in response to signals from said second sensor; and a third sensor for sensing the position of the vertical axis of said opening with respect to said surface to be treated and means for moving said blasting member about said pivot in response to signals from said third sensor.

4. The apparatus according to claim 3 wherein said adjusting means includes hydraulic motors for moving said holding means about said shaft, and said blasting member about said pivot.

5. The apparatus according to claim 4 wherein said motors include fluid actuated piston and cylinder means.

6. The apparatus according to claim 5 wherein valve means are included for supplying hydraulic fluid to said piston and cylinder means.

7. The apparatus according to claim 6 further comprising actuator means for actuating said valve means in response to said sensor means.

8. The apparatus according to claim 7 wherein said actuator means includes solenoid means, said sensor means being capable of emitting electrical signals corresponding to the position of said opening with respect to the surface to be treated such that said solenoid means operate as a function of said position of said opening.

9. The apparatus according to claim 8 wherein said shaft is pivotally mounted on said distal end portion, said motor means includes a first motor having piston and cylinder means wherein one of said piston and cylinder is pivotally attached for movement with said shaft member and the other is pivotally attached to the distal end of said boom to pivot said shaft member.

10. The apparatus according to claim 9 wherein said motor means includes a second motor having piston and cylinder means wherein one of said piston and cylinder is pivotally attached to said blasting member and the other is mounted on said holding means to pivot said blasting member about said pivot depending upon the position sensed by said third sensor.

11. The apparatus according to claim 10 wherein said motor means includes a third motor for rotating said holding means and said blast member about said shaft depending upon the position sensed by said second sensor.

12. An apparatus for treating a surface comprising a support, a boom carried by said support, said boom having an end portion proximal to said support and a distal end portion remote from said support, a blasting member positioned on said distal end portion for rotation about a vertical axis and a horizontal axis and having a blasting opening;

means for rotating said blasting member about said vertical axis, for rotating about said horizontal axis and for moving said blasting member toward and away from said surface;

a first sensor being positioned on said blasting member approximately on the vertical center line of the blasting opening, and approximately on said horizontal axis, for sensing movement of the blasting member toward and away from said surface;

a second sensor being positioned on said blasting member approximately on said horizontal axis and displaced from the vertical center line of said opening to sense movement of said blasting machine about said vertical axis; and a third sensor being positioned on said blasting member approximately on the vertical center line of said opening and displaced from said horizontal axis to sense movement of said blasting member about said horizontal axis.

13. The apparatus according to claim 12 including motor means for moving said blasting member toward and away from said surface and for moving said blasting member about said vertical axis and about said horizontal axis, a controller for operating said motor means in response to signals from said sensors indicating a change in position of said blasting opening with respect to said surface, said controller operating said motor means to compensate for said change in position of said blasting member and maintain said blasting opening adjacent said surface.

14. The apparatus according to claim 13 wherein said first sensor includes a first movable member for moving from a normal position, indicating the correct position of the blasting opening adjacent to said surface, to a pressed position, beyond the normal position in one direction toward the surface, and a disengaged position, beyond the normal position in the opposite direction away from said surface, said sensor transmitting a signal corresponding to the position to said first movable member, said controller operating said motor means to drive said blasting opening away from said surface upon reception of a signal indicating movement toward the surface, and driving said blasting wheel toward said surface upon reception of a signal indicating movement of said blasting member away from said surface.

15. The apparatus according to claim 14 wherein said second sensor includes a second movable member for movement from a normal position, corresponding to the correct orientation of said blasting opening about said vertical axis with respect to said surface, to a position beyond said normal position in one direction indicating rotation about said vertical axis from the correct position, said controller operating said motor means to rotate said blasting opening about said vertical axis in a direction opposite to the movement as indicated by the signal transmitted to said controller.

16. The apparatus according to claim 15 wherein said third sensor including a third movable member for movement from a normal position, corresponding to the correct orientatin of said blasting opening about said horizontal axis, to a position beyond the normal position in one direction, indicating rotation about said horizontal axis in said one direction, and beyond the normal position in the opposite direction, indicating rotation of said blasting opening in another direction, said controller operating said motor means to rotate said blasting opening about said horizontal axis in a direction opposite to the direction of movement as indicated by the signal transmitted to said controller.

17. The apparatus according to claim 16, wherein said means for moving said blasting opening toward and away from said surface to be treated includes means for extending and retracting said boom.

18. The apparatus according to claim 16, wherein said means for moving said blasting opening toward and away from said surface to be treated includes means for rotating said boom toward and away from the surface to be treated.

19. The apparatus according to claim 16, wherein said means for moving said blasting opening toward and away from the surface to be treated includes means for extending and retracting said boom member and means for rotating said boom member toward and away from the surface, said controller including means for selecting one of said means for moving said boom.

20. The apparatus according to claim 17 or 19 including means for moving said boom substantially through a vertical path.

21. The apparatus according to claim 17 or 19 including means for swinging said boom through an arc.

22. The apparatus according to claim 21, wherein said controller includes means for manually operating said motor means independently of said sensors, and said controller including means for selecting said manual means or said sensors to effect movement of said blasting opening.

23. The apparatus according to claim 22, wherein said opening is surrounded by a movable frame member movable with respect to said blasting member, for contacting the surface to be treated, said sensors being connected between said movable frame and said fixed frame to sense the relative movement therebetween.

24. The apparatus of claim 23 wherein said blasting member has a blasting wheel and elevator means for recycling used blasting solids to said wheel.

* * * * *

UNITED STATES PATENT AND TRADEMARK OFFICE

CERTIFICATE OF CORRECTION

PATENT NO. : 4,286,417

DATED : September 1, 1981

INVENTOR(S) : Shelton

It is certified that error appears in the above-identified patent and that said Letters Patent are hereby corrected as shown below:

Column 1, line 45, "relay" should be --rely--.

Column 6, line 29, "wouuld" should be --would--.

Column 7, line 29, "is is" should be --it is--.

Column 8, line 35, "possible" should be --possibly--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*